United States Patent [19]

Fischer

[11] 3,956,996

[45] May 18, 1976

[54] PIVOTED SLIDE GATE LOCK

[75] Inventor: Robert T. Fischer, Homewood, Ill.

[73] Assignee: Miner Enterprises, Inc., Chicago, Ill.

[22] Filed: June 14, 1974

[21] Appl. No.: 479,216

[52] U.S. Cl. ..... 105/308 B; 105/282 P; 105/308 P; 105/309

[51] Int. Cl.[2] ..... B61D 7/20; B61D 7/26; B61D 7/32; E05B 65/14

[58] Field of Search ..... 105/282 P, 308 R, 308 P, 105/308 B, 309

[56] References Cited

UNITED STATES PATENTS

| | | | |
|---|---|---|---|
| 2,638,060 | 5/1953 | Dorey | 105/282 P |
| 2,993,452 | 7/1961 | Dorey | 105/282 P |
| 3,104,623 | 9/1963 | Dorey | 105/309 X |
| 3,536,013 | 10/1970 | Nagy | 105/282 P |

*Primary Examiner*—Albert J. Makay
*Assistant Examiner*—Howard Beltran
*Attorney, Agent, or Firm*—Darbo, Robertson & Vandenburgh

[57] ABSTRACT

Pivoted lock means for selectively blocking rotation of an operating shaft associated with a slide gate in a hopper outlet assembly whereby to prevent opening of the gate.

3 Claims, 8 Drawing Figures

PIVOTED SLIDE GATE LOCK

FIELD OF THE INVENTION

The present invention pertains generally to hopper outlet assemblies, which are adapted for use in connection with railroad hopper cars, and through which lading within the car is adapted to be discharged by gravity.

SUMMARY OF THE INVENTION

One type of hopper outlet assembly includes frame means with a rectangular main frame defining a discharge opening through which lading can flow by gravity, a gate slidably supported in the frame means, and an operating shaft rotatably carried by the gate adjacent the rear portion thereof for selectively moving the gate forwardly and rearwardly between open and closed positions relative to the discharge opening.

The present invention is concerned with lock means for selectively blocking the movement of the gate when it is fully closed thus preventing it from opening. The lock means comprises a stop member secured to the frame means and presenting a bearing surface which faces forwardly, a lock shaft rotatably carried by the gate parallel to the operating shaft rearwardly thereof, and a radially extending cam plate sector secured to the lock shaft in longitudinal alignment with the bearing surface and presenting an arcuate cam surface.

The cam plate sector is normally rotatably in one direction to pivot the cam surface into engagement with the bearing surface when the gate is in its fully closed position to block movement of the gate away from its fully closed position. The cam plate sector may be inactivated by rotation in the other direction to pivot the cam surface out of engagement with the bearing surface to permit movement of the gate away from its closed position.

The lock means of the present invention is self-locking, can be interlocked only when the gate is closed, is arranged to substantially prevent accidental unlocking thereof, and may be manually unlocked from either side of the hopper outlet assembly.

DESCRIPTION OF THE PREFERRED EMBODIMENT

Figure 1:
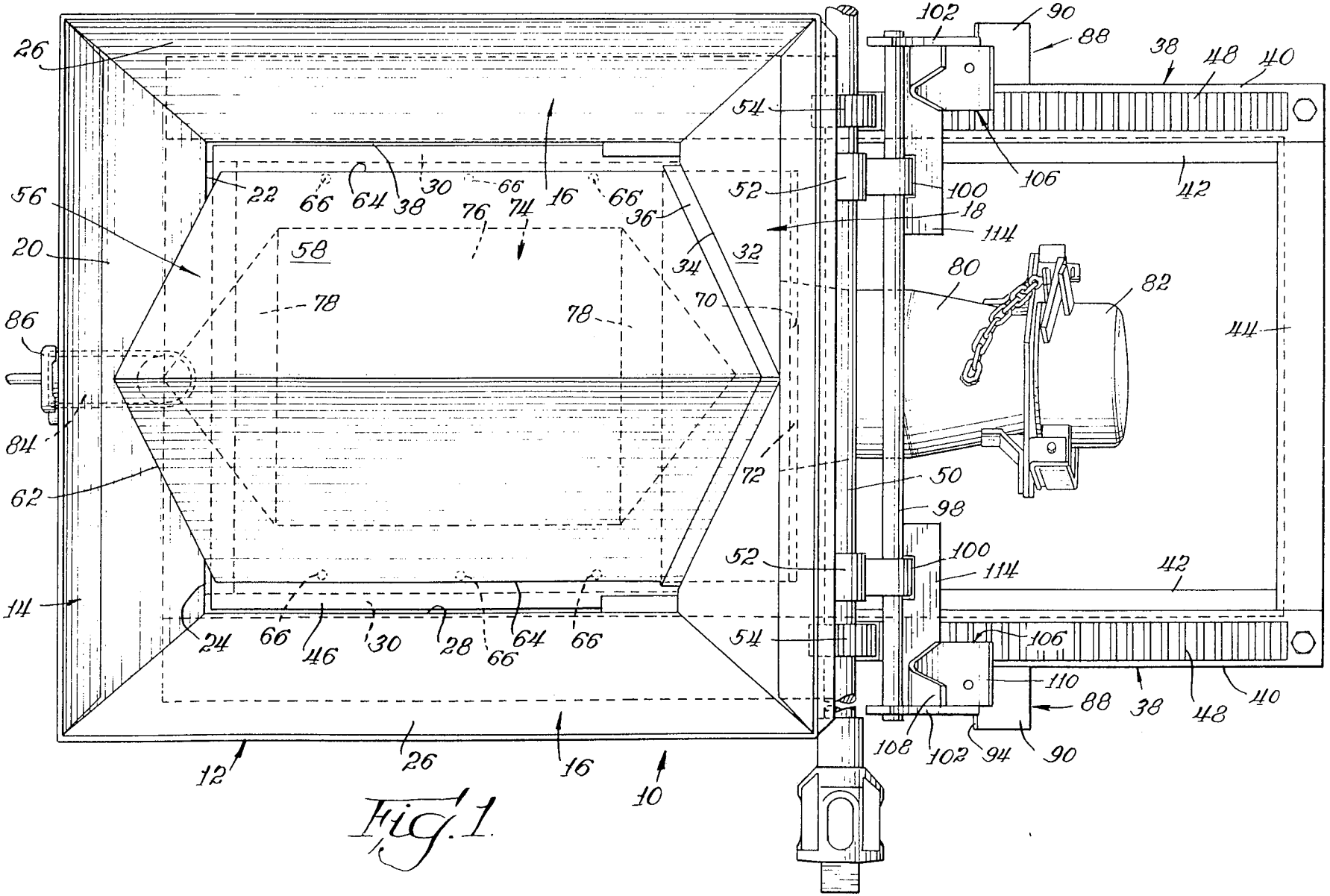
FIG. 1 is a plan view of a hopper outlet assembly incorporating the lock means of the present invention.
Figure 2:
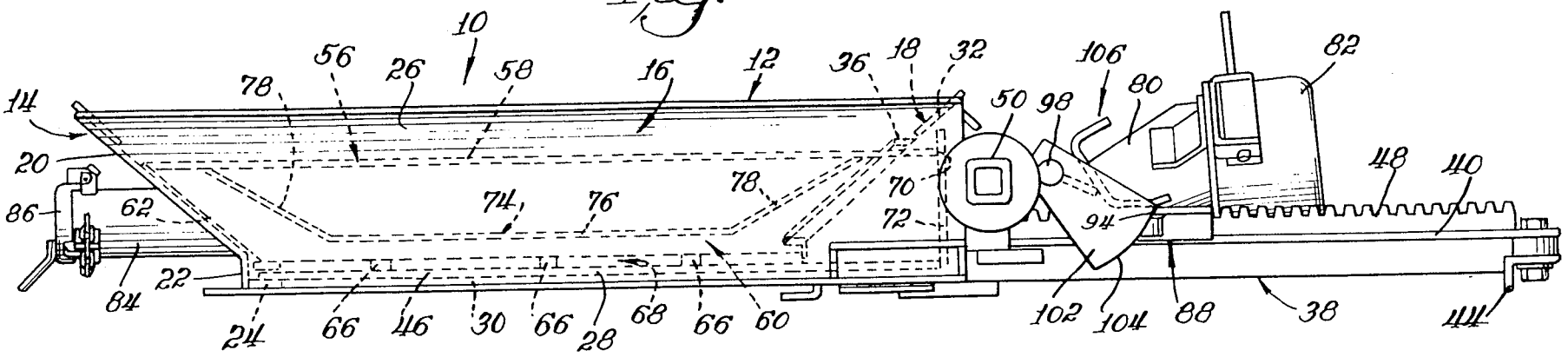
FIG. 2 is a side elevational view of the hopper outlet assembly of FIG. 1.
Figure 3:
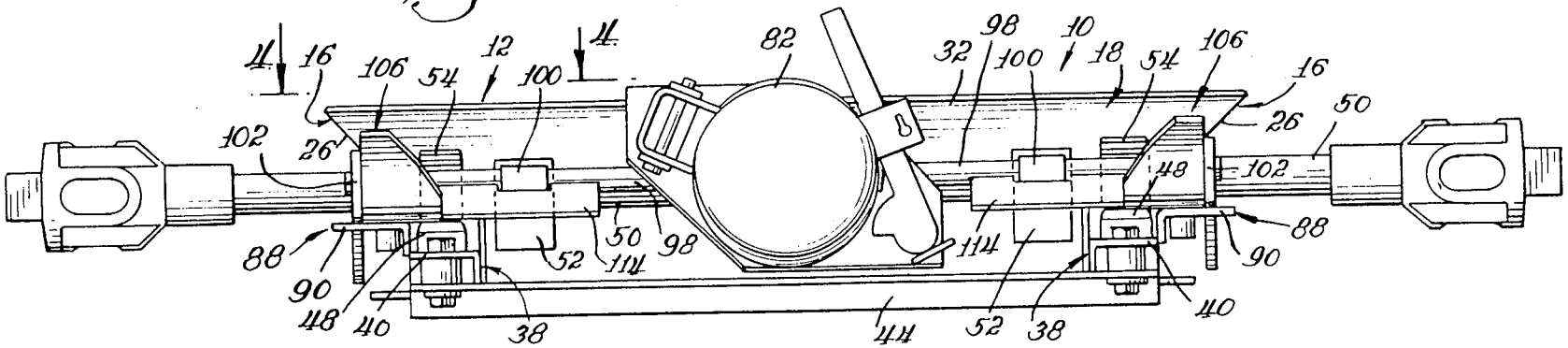
FIG. 3 is a rear elevational view of the hopper outlet assembly of FIG. 1.

Referring now to FIGS. 1–3, there is indicated generally by the reference numeral 10 a hopper outlet assembly which, as will be understood by those skilled in the art, is adapted to be arranged at the lower end of a conventional hopper section of a railroad hopper car.

The hopper outlet assembly 10 is comprised of a generally horizontally disposed rectangular main frame 12 having a front frame section 14, side frame sections 16, and a rear frame section 18. The front frame section 14 includes an upper sloping wall portion 20, a vertical wall portion 22, and a lower inwardly directed flange portion 24. Similarly, the side frame sections 16 each includes an upper sloping wall portion 26, a vertical wall portion or border 28, and a lower inwardly directed flange portion 30. The rear frame section 18 includes an upper sloping wall portion 32 with an inverted V-shaped cut-out 34 along which is secured a projecti;ng cover strip 36. The sloping wall portions 20, 26 and 32 are adapted to be suitably secured, as by welding, to the lower portion of a hopper, and the main frame 12 defines a discharge opening, with parallel horizontal side borders, through which lading can flow by gravity from the hopper.

Projecting away from the side frame sections 16 in parallel relationship are extension assemblies 38 which have upper outwardly directed flange portions 40 and lower inwardly directed flange portions 42 in alignment with the flange portions 30 of the side frame sections 16. The rear ends of the extension assemblies 38 are interconnected by a transverse angle bar 44. The main frame 12 and extension assemblies 38 constitute frame means.

A generally horizontal rectangular slide gate 46 is slidable along the flange portions 30 and 42 between a first position across the discharge opening to close the same and a second position away from the discharge opening. In this connection, the flange portion 24 of the front frame section 14 serves to support the front edge of the gate 46 when the latter is in its closed position.

Means for operating the gate 46 includes a pair of rack members 48 which are secured to the upper flange portions 40 of the extension assemblies 38. Located above the rack members 48 is a transverse operating shaft 50 rotatably journaled in brackets 52 having connection with the trailing edge of the gate 46. A pair of pinion gears 54 are secured on the operating shaft 50 and have meshing engagement with the rack members 48. Rotation of the operating shaft 50 and pinion gears 54 serves to effect movement of the gate 46 between its closed and open positions.

Mounted above, and movable with, the gate 46 is a hood unit 56 which includes an inverted V-shaped hood member 58 extending lengthwise of the main frame 12 and defining with the gate 46 a plenum chamber 60 into which lading may flow. The front edge or border 62 of the hood member 58 is normally spaced from the sloping wall portion 20 of the front frame section 14 to provide an opening through which lading may flow into the plenum chamber 60. The size of this opening can be varied slightly, by moving the gate 46 forward or backward, for accommodating efficient lading clean-out. The parallel horizontal side edges or borders 64 of the hood member 58 are supported on support member 66 secured to the gate 46, and are spaced both from the side borders 28 of the side frame sections 16 and from the gate 46 to define elongated openings 68 through which lading may flow into the plenum chamber 60. The rear edge 70 of the hood member 58 has secured thereto a rear wall 72 which extends downwardly to the gate 46 and which supports the brackets 52. Disposed within the plenum chamber 60 is restriction means in the form of a restrictor plate 74 which comprises a horizontal base portion 76 and upwardly inclined end portions 78, and which is secured along its edges to the underside of the hood member 58.

Secured in the rear wall 72 of the hood unit 56, and communicating with the plenum chamber 60, is an outlet conduit section 80 which is adapted to be connected to a pneumatic or vacuum system in a known manner. The outer end of the conduit section 80 is provided with a conventional cap 82 for closing the same and sealing the plenum chamber 60 when the latter is not in use. Secured in the front frame section 14, and communicating with the plenum chamber 60, is an auxiliary air inlet conduit section 84 provided with a conventional cap 86 which may be opened as and to the extent desired to permit secondary air to enter into the plenum chamber 60.

Figure 6:
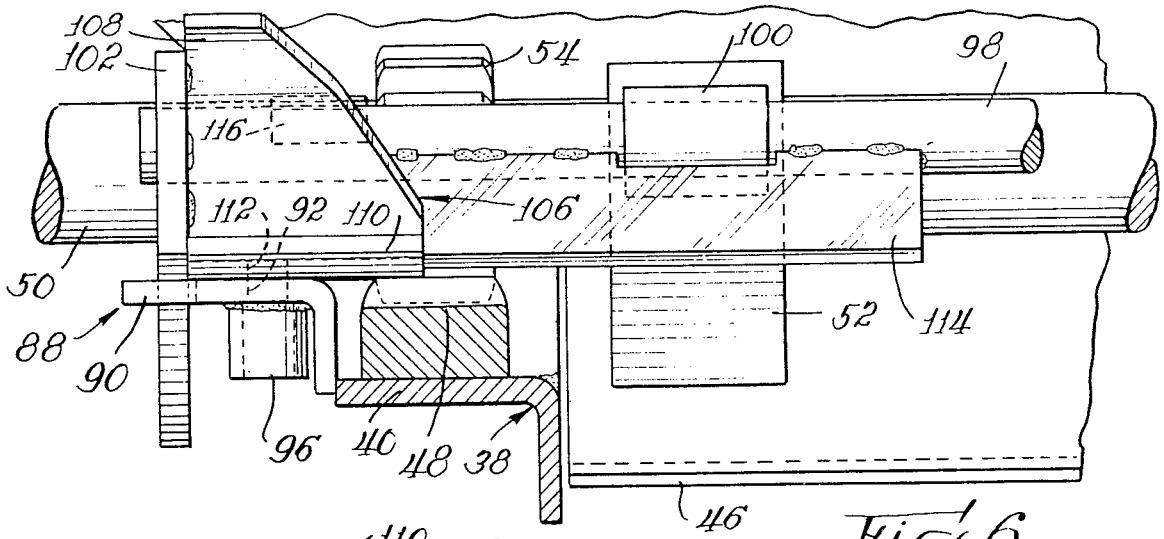
FIG. 6 is a fragmentary rear view taken substantially along the plane 6—6 in FIG. 4 looking in the direction indicated by the arrows.
Figure 7:
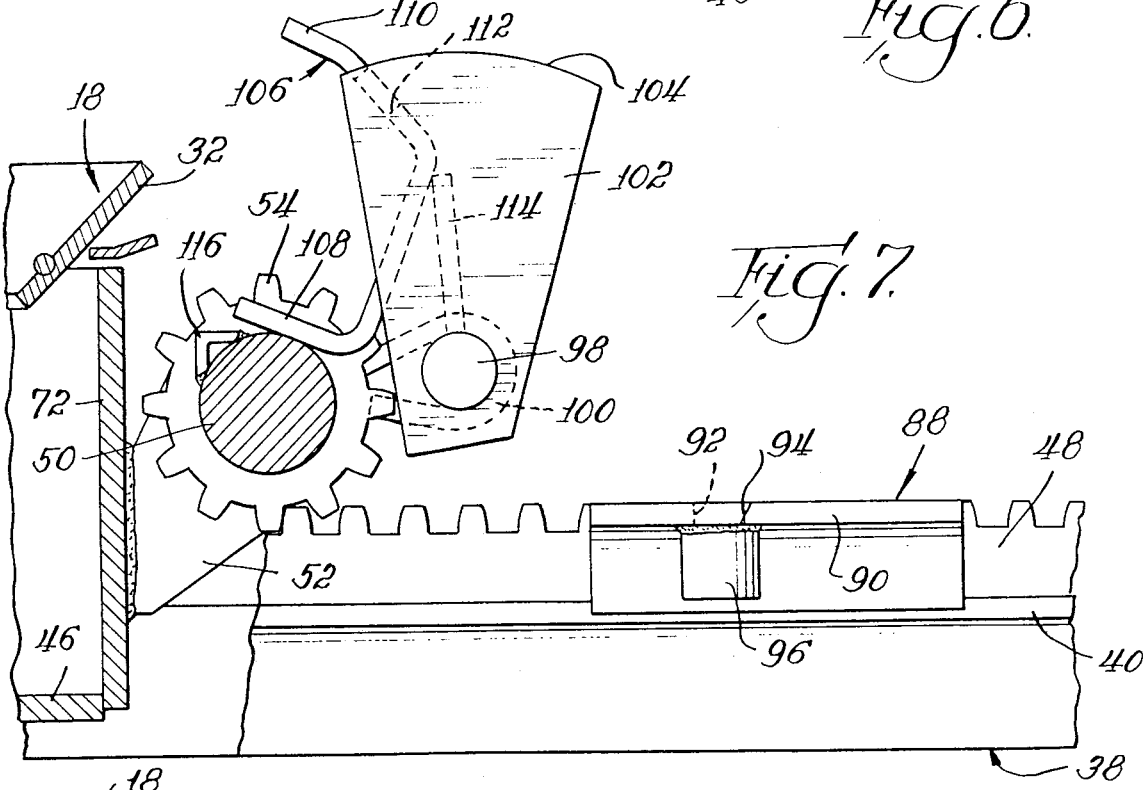
FIG. 7 is a fragmentary side view corresponding generally to FIG. 5, but shows certain elements in one changed position.

The lock means of the present invention for securing the slide gate 46 in closed position across the discharge opening comprises stop members 88 secured to the outboard sides of the extension assemblies 38 rearwardly of the rear frame section 18. As shown in FIGS. 6 and 7, each stop member 88 is i;n the form of an angle bracket having a flange portion 90 provided with an aperture 92 and presenting a bearing surface 94 which faces forwardly. Secured to the underside of the flange 90 about the aperture 92 is a collar member 96.

As shown in FIGS. 1 and 2, transverse lock shaft 98 is rotatably journaled in brackets 100 secured to the operating shaft brackets 52 and is thereby carried by the slide gate 46 parallel to the operating shaft 50 rearwardly thereof. Radially extending cam plate sectors 102 are secured to the lock shaft 98 at the ends thereof in longitudinal alignment with the bearing surfaces 94 of the stop members 88. Each cam plate sector 102 presents an arcuate cam surface 104.

Figure 4:
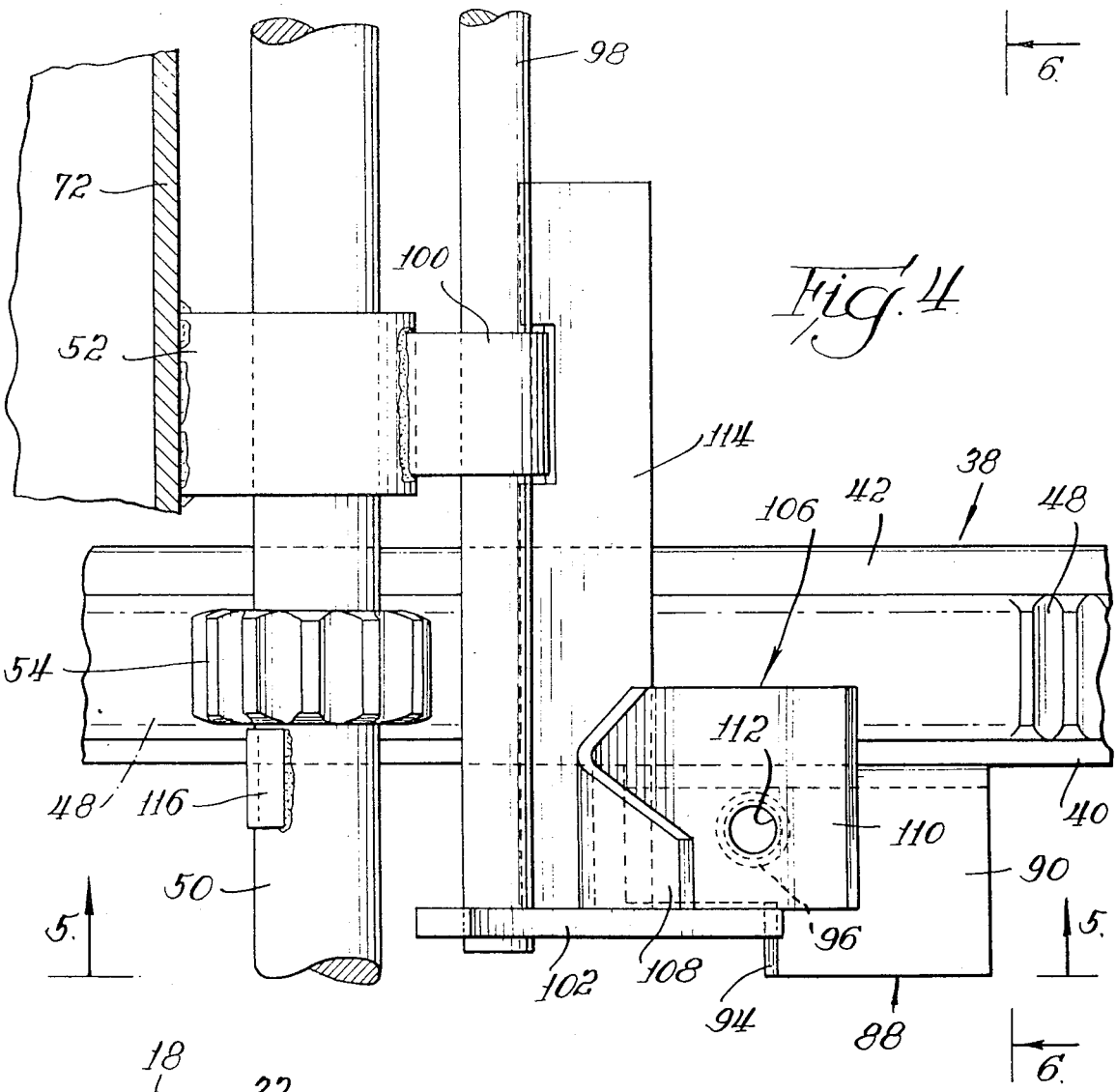
FIG. 4 is an enlarged fragmentary plan view taken substantially along the plane 4—4 in FIG. 3 looking in the direction indicated by the arrows.
Figure 5:
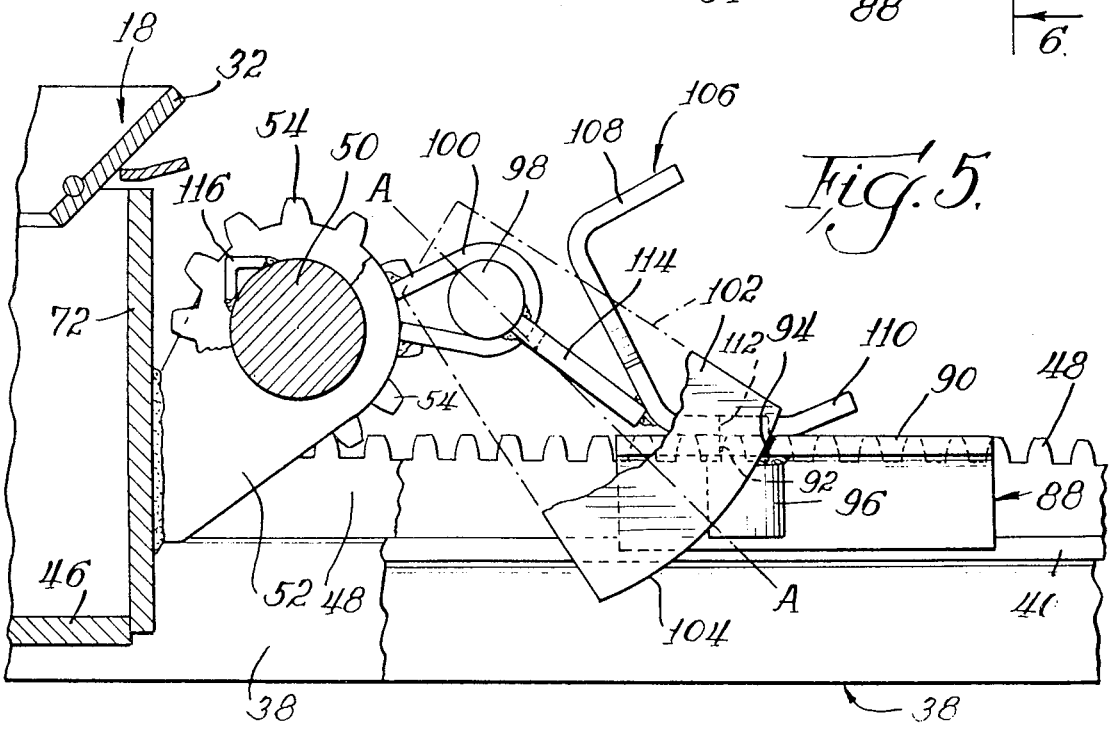
FIG. 5 is a fragmentary side view taken substantially along the plane 5—5 in FIG. 4 looking in the direction indicated by the arrows.

Secured to the inboard sides of the cam plate sectors 102, as shown in FIGS. 4 and 5, are generally U-shaped abutment members 106 having spaced legs 108 and 110. Each abutment leg 110 is formed with an aperture 112. The cam plate sectors 102 and the abutment members 106 are reinforced by braces 114. Secured to the operating shaft 50 are projections 116 which are engageable with the abutment legs 108.

Operationally, the cam plate sectors 102 normally tend to rotate clockwise as viewed in FIGS. 2 and 5 to pivot the cam surfaces 104 into engagement with the bearing surfaces 94 when the gate 46 is in its fully closed position. The cam surfaces 104 are fully engaged when the abutment legs 110 engage the top flanges 90. The cam plate sectors 102, when disposed as shown in FIGS. 4–6, block movement of the gate 46 away from its fully closed position. Also, when the cam plate sectors 102 are so disposed, conventional seal units may be fastened through the apertures 92 and 112 and collars 96.

Referring to FIG. 5, the center of curvature of the cam surfaces 104 is offset below the axis of the lock shaft 98 whereby to provide negative cam profiles, and normal locking engagement of the cam surfaces 104 when the bearing surfaces 94 occurs overcenter along a line that lies above the transverse center plane A—A of the cam plate sectors 102. By reason of this arrangement, accidental unlocking of the lock means is substantially prevented, and any attempt to rotate the operating shaft 50 to open the gate 46 increases the locking interfit between the cam plate sectors 102 and the stop members 88.

To inactivate the lock means when gravity discharge of lading is desired, the cam plate sector 102 at either side of the assembly 10 is manually grasped and rotated from the position shown in FIG. 5 to the fully unlocked position shown in FIG. 7 established by contact of the abutment legs 108 with the operating shaft 50. Rotation of one cam plate sector 102 effects rotation of the other sectors 102 through the lock shaft 98, initial rotation of the sectors 102 serves to break any associated seal units, and rotation of both sectors pivots the cam surfaces 104 out of engagement with and away from the bearing surfaces 94.

Figure 8:
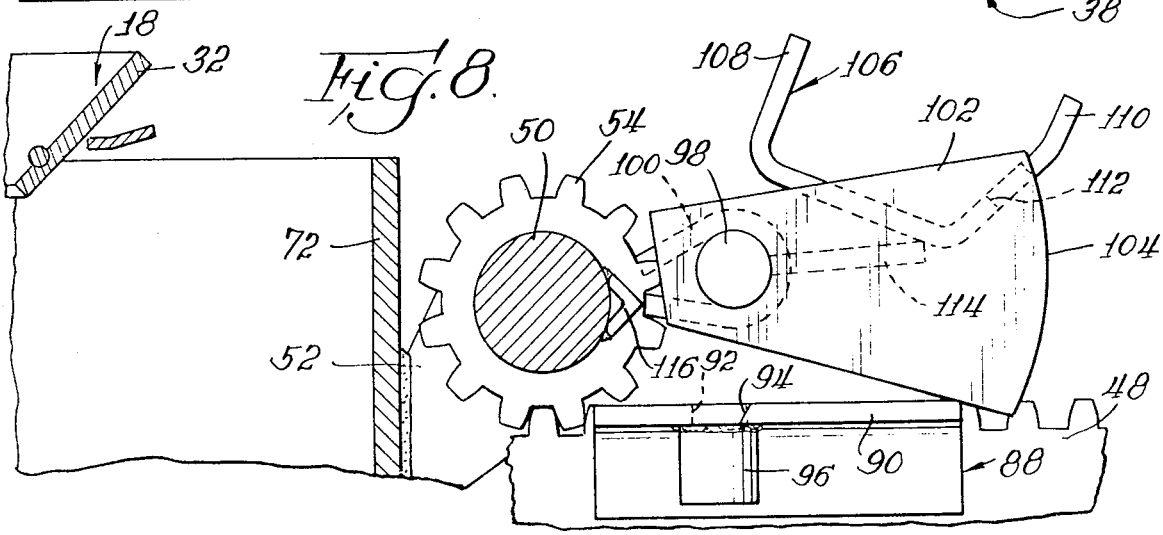
FIG. 8 is a fragmentary side view corresponding generally to FIG. 5, but shows certain elements in another changed position.

When the cam plate sectors 102 have been rotated to the position shown in FIG. 7, the abutment members 106 serve as counterweights or counterbalances to temporarily maintain the sectors 102 in this inactive position. With the lock means thus unlocked, the operating shaft 50 may be rotated to move the gate 46 and the hood unit 56 away from the discharge opening to permit gravity discharge of lading therethrough. Upon initial rotation of the operating shaft 50, the projections 116 engage the abutment legs 108 for dislodging the sectors 102 from their inactive position. The sectors 102 then swing down toward the position shown in FIG. 8 and ride over and behind the stop members 88, while the abutment legs 110 ride over the rack members 48, during opening of the gate 46.

After the lading has been discharged by gravity in a conventional manner, the operating shaft 50 is rotated to return the gate 46 and hood unit 56 to the position shown in FIGS. 1 and 2 across the discharge opening. As the gate 46 approaches its closed position, the cam plate sectors 102 engage and ride over the stop members 88, and rotate to their locked position shown in FIG. 5 with the abutment legs 110 engaging the stop members 88 for limiting the extent of engagement of the cam surfaces 104 with the bearing surfaces 94.

With the gate 46 in its closed, locked position, the hopper outlet assembly 10 is adapted for pneumatic or vacuum discharge of lading. When such discharge is desired, the cap 82 is opened, and a vacuum hose (not shown) is attached to the conduit section 80. Upon activation of the pneumatic or vacuum source, lading within the hopper flows down through the opening along the front border 62 of the hood member 58 and through the elongated side openings 68 into the plenum chamber 60, and is entrained in the air of the system in a conventional manner for discharge of the same from the plenum chamber 60 through the outlet conduit section 80. During vacuum discharge, the restrictor plate 74 serves to close off a portion of the plenum chamber 60 and thereby constricts the flow of lading therethrough.

While there has been shown and described a preferred embodiment of the present invention, it will be understood by those skilled in the art that various modifications and rearrangements may be made therein without departing from the spirit and scope of the invention.

The invention claimed is:

1. For use in a hopper outlet assembly including frame means with a generally rectangular main frame having a front frame section and a rear frame section and side frame sections defining a discharge opening through which lading can flow by gravity, a generally rectangular gate slidably supported in the frame means, and a transverse operating shaft rotatably carried by the gate adjacent the rear portion thereof for selectively moving the gate forwardly and rearwardly between open and closed positions relative to the discharge opening, lock means comprising a stop member secured to the frame means rearwardly of the rear frame section and presenting a bearing surface which faces forwardly, a transverse lock shaft rotatably carried by the gate parallel to the operating shaft rearwardly thereof, a radially extending cam plate sector secured to said lock shaft in longitudinal alignment with said bearing surface and presenting an arcuate cam surface, said cam plate sector normally being rotatably in one direction to pivot said cam surface into engagement with said bearing surface when the gate is in its fully closed position to block movement of the gate away from its fully closed position, an abutment member secured to said cam plate sector and being engageable with said stop member for limiting the extend of engagement of said cam surface with said bearing surface, and said cam plate sector being inactivated by rotation in the other direction to pivot said cam surface out of engagement with said bearing surface to permit movement of the gate away from its closed position.

2. The lock means of claim 1 wherein said abutment member serves as a counterbalance to temporarily maintain said cam plate sector in an inactive position after the latter has been rotated to such position.

3. The lock means of claim 2 including a projection on the operating shaft which is engageable with said abutment member for dislodging said cam plate sector from its inactive position.

* * * * *

UNITED STATES PATENT AND TRADEMARK OFFICE

CERTIFICATE OF CORRECTION

PATENT NO. : 3,956,996

DATED : May 18, 1976

INVENTOR(S) : Robert T. Fischer

It is certified that error appears in the above-identified patent and that said Letters Patent are hereby corrected as shown below:

Column 1, line 31, "rotatably" should read --rotatable--.
Column 2, line 21, "projecti;ng" should read --projecting--.
Column 3, line 31, "i;n" should read --in--.
Column 3, line 36, before "transverse" should be inserted --a--.
Column 3, line 58, "top" should read --stop--.
Column 4, line 16, "sectors" should read --sector--.
Column 5, lines 19-20, "rotatably" should read --rotatable--.
Column 6, lines 5-6, "extend" should read --extent--.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*